US011841115B2

(12) United States Patent
Van Bommel et al.

(10) Patent No.: US 11,841,115 B2
(45) Date of Patent: Dec. 12, 2023

(54) LED FILAMENT LIGHTING DEVICE

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/762,758

(22) PCT Filed: Sep. 28, 2020

(86) PCT No.: PCT/EP2020/077109

§ 371 (c)(1),
(2) Date: Mar. 23, 2022

(87) PCT Pub. No.: WO2021/063889

PCT Pub. Date: Apr. 8, 2021

(65) Prior Publication Data

US 2022/0341549 A1 Oct. 27, 2022

(30) Foreign Application Priority Data

Oct. 3, 2019 (EP) ..... 19201277

(51) Int. Cl.
*F21K 9/232* (2016.01)
*F21V 3/04* (2018.01)

(52) U.S. Cl.
CPC ..... *F21K 9/232* (2016.08); *F21V 3/049* (2013.01)

(58) Field of Classification Search
CPC ... F21K 9/23; F21K 9/232; F21K 9/60; F21V 3/049; F21Y 2115/10; F21Y 2113/17
See application file for complete search history.

(56) References Cited

U.S. PATENT DOCUMENTS

| | | | | |
|---|---|---|---|---|
| 10,359,152 | B2 * | 7/2019 | Jiang | F21K 9/232 |
| 2014/0268779 | A1 * | 9/2014 | Sorensen | F21K 9/232 362/249.06 |
| 2017/0241598 | A1 | 8/2017 | Jiang et al. | |
| 2018/0031185 | A1 | 2/2018 | Pettmann | |
| 2019/0113181 | A1 | 4/2019 | Schlereth et al. | |

FOREIGN PATENT DOCUMENTS

| | | | |
|---|---|---|---|
| DE | 102017103431 | A1 | 8/2018 |
| DE | 102017121186 | A1 | 3/2019 |
| GB | 2539190 | A | 12/2016 |
| KR | 2018048051 | A | 5/2018 |
| WO | 2018202625 | A1 | 11/2018 |

* cited by examiner

*Primary Examiner* — Peggy A Neils

(57) ABSTRACT

An LED filament lighting device comprising, at least one LED filament, each including a plurality of LEDs mounted on an elongated substrate, at least one light scattering element, each including a light scattering shell surrounding a transparent volume, each light scattering element being arranged to encompass at least one LED of at least one LED filament, and configured to scatter light emitted from the encompassed LED(s), thereby forming a first LED set including at least one LED encompassed by said at least one scattering element, and a second LED set including a plurality of LEDs not encompassed by said at least one scattering element, wherein a light distribution from said first LED set combines with a light distribution from said second LED set to provide an improved total light distribution from said LED filament lighting device.

15 Claims, 4 Drawing Sheets

LED FILAMENT LIGHTING DEVICE

CROSS-REFERENCE TO PRIOR APPLICATIONS

This application is the U.S. National Phase application under 35 U.S.C. § 371 of International Application No. PCT/EP2020/077109, filed on Sep. 28, 2020, which claims the benefit of European Patent Application No. 19201277.1, filed on Oct. 3, 2019. These applications are hereby incorporated by reference herein.

FIELD OF THE INVENTION

The present invention relates to LED filaments, i.e. linear arrays of LEDs arranged on a carrier substrate, used e.g. in retrofit light bulbs. Specifically, the present invention relates to providing better light distribution and decorative appearance in a LED filament lighting device.

BACKGROUND OF THE INVENTION

Incandescent lamps are rapidly being replaced by LED based lighting solutions. It is nevertheless appreciated and desired by users to have retrofit lamps which have the look of an incandescent bulb. For this purpose, one can simply make use of the infrastructure for producing incandescent lamps based on glass and replace the filament with LEDs emitting white light. One of the concepts is based on LED filaments placed in such a bulb. The appearances of these lamps are highly appreciated as they look highly decorative.

One such LED based solution is known from US 2019/0113181 A1, describing an LED filament for a lamp wherein a multiplicity of light emitting semiconductor chips are arranged on a carrier, and are electrically contacted. Light emitting semiconductor chips have an emission characteristic of the emitted light which is angle dependent. This is in contrast with the emission characteristic of conventional incandescent lamps, which is relatively independent of the emission angle. Therefore, in LED filament lamps it is a common problem to have non-homogeneous light distribution, or even dark zones or shadows resulting from this inhomogeneity. To offer a solution to this problem in US 2019/0113181 A1 a scattering structure is provided in order to scatter light of the light emitting chips. The scattering structure is formed by structuring the surface that encloses the carrier.

However, the solution proposed in US 2019/0113181 A1, namely structuring the surface through methods such as grinding or etching is time consuming and expensive. In addition, in the case of LED filament lamps comprising multiple filaments, the positioning of these filaments relative to each other may again lead to an uneven total light distribution of the lamp.

US 2018/031185 discloses a lighting device that includes several LED filaments disposed inside a partially transparent external container and connected to anode and cathode output terminals. Each LED filament further includes an envelope overmoulded around the diodes and the substrate, and two electrodes forming the anode and the cathode of the LED filament protruding from the envelope.

WO 2018/202625 discloses a lighting device comprising: at least one LED-filament with a substrate having an elongated body and a plurality of light sources configured for emitting light in a first spatial light distribution, further comprising at least one light guide having an elongated body, for coupling light out of the at least one light guide in a second spatial light distribution.

SUMMARY OF THE INVENTION

It is therefore an object of the present invention to overcome this problem, and to provide an LED filament lamp with a relatively homogenous total light distribution.

The present invention relates to an LED filament lamp in accordance with the independent claim 1. Preferred embodiments are defined by the dependent claims.

According to a first aspect of the invention, this and other objects are achieved by an LED filament lighting device comprising, at least one LED filament, each including a plurality of LEDs mounted on an elongated substrate, at least one light scattering element, each including a light scattering shell surrounding a transparent volume, each light scattering element being arranged to encompass at least one LED of at least one LED filament, and configured to scatter light emitted from the encompassed LED(s), thereby forming a first LED set including at least one LED encompassed by the at least one scattering element, and a second LED set including a plurality of LEDs not encompassed by the at least one scattering element, wherein a light distribution from the first LED set combines with a light distribution from the second LED set to provide an improved total light distribution from the LED filament lighting device.

With this design, the scattering element(s) will alter the spatial distribution of the encompassed LED(s). Thereby, an improved and essentially homogeneous total light distribution from the LED filament lighting device can be achieved.

The scattering element(s) may be positioned to partially encompass portions of LED filaments that contribute to an uneven spatial distribution of light. Examples of such positions where the total intensity of light may be higher than the remaining portions of the filaments could be the curves on a long, spiral filament, or alternatively in case of multiple filaments, places where the filaments meet. An example of the positions where the total intensity of the emitted light may be lower than the remaining portions of the filaments would be where a filament is connected to an electrode.

The light scattering elements may be positioned on the end portions of the LED filament. This may be the case when the first LED set is situated at an outer end of the LED filament.

The first LED set may comprise at least one red, one blue, and one green LED (RGB) on one filament, such that the encompassed portion of the filament may have the possibility to emit white light, as well as any other light color.

Both first and second LED sets may be configured to emit the light with the same color point, for example, the same color temperature, or alternatively, the two LED sets may be configured to emit light with different color points, such as different color temperatures.

The transparent volume may be a void volume, such that the light scattering element is a hollow object. Alternatively, the transparent volume may be filled with another, light transparent, non-scattering material, which may or may not have a different refractive index compared to air. For example, the transparent volume may be composed of glass or plastic.

The light scattering element may be for example a sphere, or alternatively, may have any other geometrical shape, such as a cube. The light scattering element may be a separate element, that is integrated onto the LED filament.

The transparent volume may be symmetrical, such as a sphere, or non-symmetrical, such as a cylindrical volume.

The geometrical shape of the transparent volume may or may not follow the geometrical shape of the light scattering element. Preferably though, the transparent volume follows the shape of the light scattering element to render better light mixing properties.

A thickness of the light scattering shell may be less than 0.5, preferably less than 0.3, and more preferably less than 0.1 times a largest dimension of the transparent volume. In the case of a symmetrical transparent volume, all three dimensions of the transparent volume will be equal. In case of a non-symmetrical inner volume, at least one dimension will be larger than the others.

The light scattering shell may be arranged to be semi-reflective. By this, the light scattering element may serve as a mixing chamber, wherein the light emitted by the encompassed LEDs is mixed. This mixed light then exits the light scattering element, resulting in a more homogenous distribution.

The inner surface may have a reflectivity in the range of 30-80%, preferably 35-70%, and most preferably 40-60%.

Several (i.e. at least two) light scattering elements may encompass at least one encompassed LED of one single LED filament. In other words, one LED filament may be encompassed by several scattering elements, for example one in each end.

Further, a light scattering element may encompass at least one encompassed LED of several (i.e. at least two) different LED filaments. For example, one scattering element may encompass the ends of two or more LED filaments.

A light scattering element may be used to fixate an LED filament, either to another LED filament or to some other structure. For example, the scattering element may mechanically connect two or more filaments to each other.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

Figure 1C:
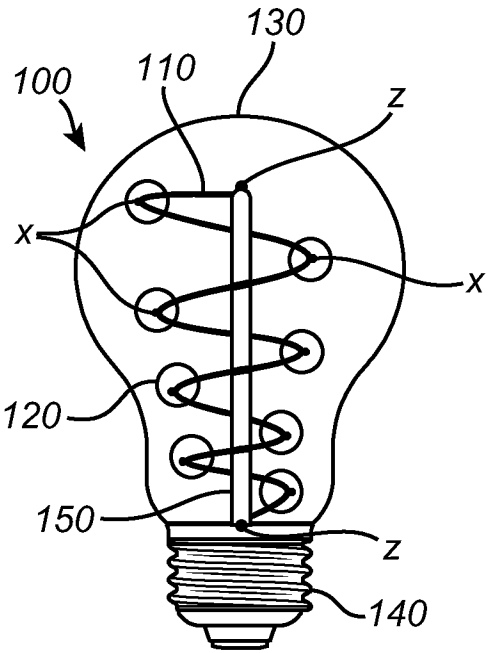
FIGS. 1*a*-1*c* demonstrate a retrofit lightbulb comprising LED filaments and spherical scattering elements arranged at different positions along the length of the filament.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

FIG. 1 demonstrates a LED filament lighting device, here by example in the form of a retrofit light bulb 100 also in this application referred to as lamp, wherein one or several LED filaments 110 are accommodated within an envelope 130. The LED filaments 110 (explained in more detail below) are connected to the electrical (or mechanical) connector 140. Similar to the typical incandescent light bulbs, here in FIG. 1, the electrical connector 140, here a threaded Edison connector such E26 or E27, is to connect the lamp to an electric socket (not shown).

In the context of this invention, and as demonstrated in FIGS. 2 and 3, an LED filament 110 is defined as providing LED filament light and comprises a plurality of light emitting diodes (LEDs) 360 arranged preferably in a linear array. The LED filament 110 may have a length L and a width W, wherein L>5W. The LED filament 110 may be arranged in a straight configuration such as in FIGS. 1*a*, and 1*b*, or in a non-straight configuration such as for example a curved configuration, a 2D/3D spiral or a helix, or a meander shown in FIGS. 1*c*.

Preferably, the LEDs 360 are arranged on an elongated carrier, for instance a substrate 300, that may be rigid (made from e.g. a polymer, glass, quartz, metal or sapphire) or flexible (e.g. made of a polymer or metal e.g. a film or foil). Please note that in this text the terms "carrier" and "substrate" may be used interchangeably, and unless stated otherwise, are meant to imply the same meaning.

A carrier 300 of rigid material may provide better cooling of the LED filament 110, meaning the heat generated by the LED 110 may be distributed by the rigid substrate 300.

A carrier 300 of flexible material may provide shape freedom for designing the aesthetics of the LED filament 110 due to flexibility.

It should be noted that, the thermal management of thin, flexible material (such as foils) may typically be poorer compared to rigid material. However, on the other hand, having rigid material as the substrate 300, may limit the shape design of the LED filament 110.

The linear array in which the LEDs 360 are arranged, may be in the direction of the elongated substrate 300. The linear array is preferably a matrix of N×M LEDs 360, wherein N=1 (or 2) and M is at least 10, more preferably at least 15, most preferably at least 20 such as for example at least 30 or 36 LEDs 360.

The carrier 300 may comprise a first major surface 310, and an opposite, second major surface 320. In case the carrier 300 comprises a first major surface 310 and an opposite second major surface 320, the LEDs 360 are arranged on at least one of these surfaces. In the side view schematics of FIGS. 2*b* and 2*c*, the LEDs 360 are positioned on the first major surface 310, and on both the first 310 and second 320 major surfaces of the carrier 300, respectively.

The carrier 300 may be reflective or light transmissive, such as translucent and preferably transparent. The transmissive substrate may be composed of for example polymer, glass, quartz, etc.

The advantage of a light transmissive substrate may be that the light emitted from the LED 360 may propagate through the substrate 300, leading to a substantially omni-directional light emission.

For transmissive substrates, the encapsulant 370 may be disposed on both sides of the filament 110. This is shown in side views of FIGS. 2*b* and 2*c*. encapsulant 370 may comprise a luminescent material and/or a light scattering material.

Alternatively, the carrier 120 may be light reflective. In this embodiment light emitted by the LEDs 360 is reflected off the surface of the substrate on which the LEDs 360 are arranged on (310 and/or 320), thus hindering light from propagating the filament substrate 300.

The LED filament 110 may comprise an encapsulant 370 at least partially covering the plurality of LEDs 360. As shown in FIGS. 2*b*, and 2*c*, and FIG. 2*d* respectively, the encapsulant 370 may also at least partly cover at least one of the first major 310 or second major surface 320, or both major surfaces 310, 320. The encapsulant 370 may be a polymer material which may be flexible such as for example a silicone.

Figure 3A:
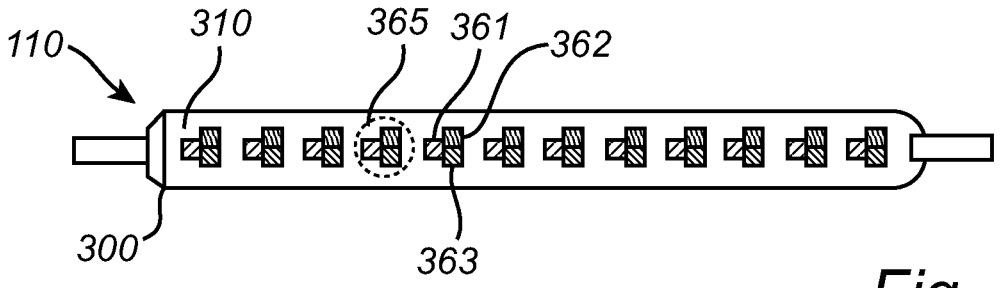
FIG. 3*a*-3*b* illustrate different embodiments of LED filaments from which white light is emitted.
Figure 3B:
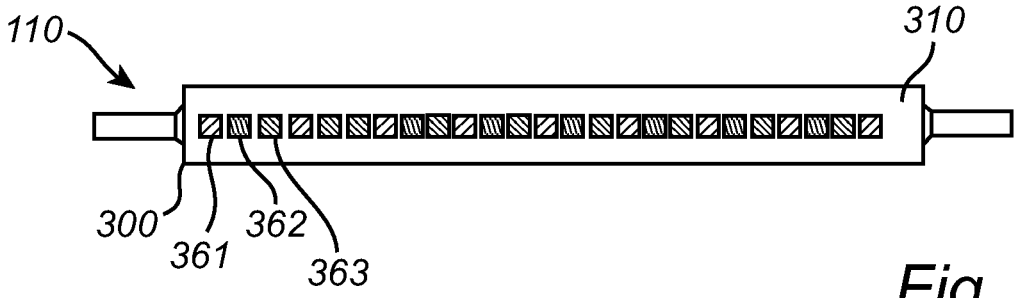

Further, the LEDs 360 may be arranged for emitting LED light e.g. of different colors or spectra. For instance, the LEDs 360 may emit white light with different color temperatures, or alternatively or simultaneously, at least some of the LEDs 360 may be groups 365 of red (R) 361, green (G) 362, and blue (B) 363 LEDs. FIGS. 3*a* and 3*b* illustrate two embodiment of the latter. The red 361, green 362, and blue 363 LEDs in each group can be arranged as groups 365 shown in FIG. 3*a*, or disposed one after the other in the longitudinal direction of the LED filament 110 such as illustrated in FIG. 3*b*.

The light emitted from the RGB LEDs may mix to render white light with cool or warm color temperatures. Alternatively, the encapsulant 370 may comprise a luminescent material that is configured to at least partly convert LED light into converted light. The luminescent material may be a phosphor such as an inorganic phosphor and/or quantum dots or rods. The first LED set may comprise no common and/or continuous encapsulant with a luminescent material. The second LED set may comprise blue and/or UV LEDs, which may be covered by a luminescent material, for example phosphor, or inorganic phosphor, such as YAG, LuAg, ECAS, and/or KSiF.

According to the invention, the first LED set refers to all encompassed LEDs of the light emitting device. In better words, the LEDs of the first LED set may be LEDs of a common LED filament positioned consecutively, or on different portions of the common LED filament, or alternatively, they may be LEDs from several LED filaments within the light emitting device.

Consequently, and in a similar manner, the second LED set refers to all non-encompassed LEDs of the light emitting device; be them consecutive or separate LEDs of a common LED filament, or from several LED filaments within the light emitting device.

At least one LED of at least one of the LED filaments 110 is encapsulated by a scattering element 120. Returning to FIG. 1, in FIG. 1*a*, a plurality of scattering elements 120 encapsulate ending portions of the LED filaments 110 where the filaments are connected; points a, and b. As a result of multiple filaments 110 crossing over at these points a, and b, the intensity of light emitted from these points a, and b of the lamp 100 will be much higher than the remaining portions of the filaments 110. The scattering elements 120 will aid render the emitted light from the lamp 100 more uniform by scattering, hence decreasing the intensity of light emitted from the portions it encompasses, such that the resulting intensity of the scattered light exiting the scattering element 120 will be closer to that of light emitted from the non-encompassed portions of the LED filaments 110.

The light scattering elements 120 are placed on the LED filaments 110 by methods such as stringing, or clamping. For instance, it may be that a light scattering element 120 has only one hole from one side, so that it may be attached to the ending portion of a filament 110. Alternatively, a light scattering element 120 may have two separate holes, which may be either continuous throughout the body of the scattering element 120, or non-continuous, for attaching two LED filaments 110, or stringing one LED filament 110, respectively. Alternatively, a light scattering element 120 may have more than two holes, for instance three, or four, or more.

Figure 1B:
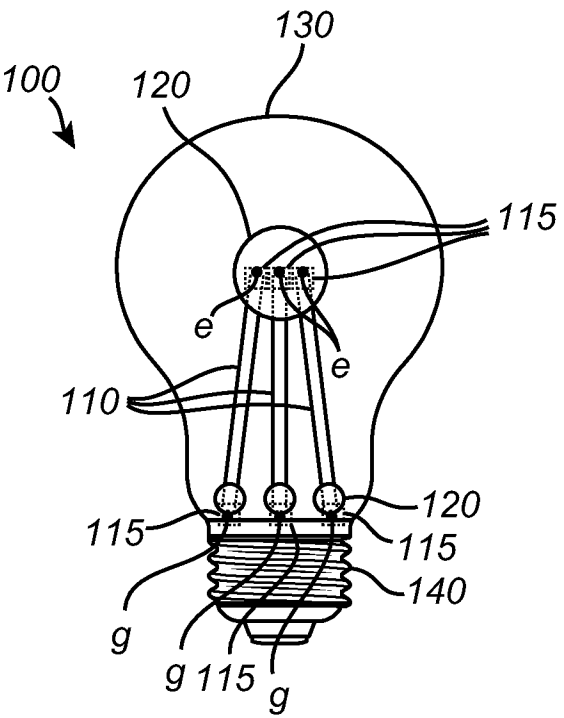

FIG. 1*b*, schematically demonstrates another embodiment of the current invention in which the LED filaments 110 and the scattering elements 120 are positioned differently compared to the previous embodiment. In FIG. 1*b*, the scattering elements are positioned at free ending points e, of single LED filaments 110, and points g at which the filaments are connected to the electrical connector 140. At points e and g, the intensity of the emitted light from the LED filaments 110 may be lower in comparison to the remainder of the filament 110. Positioning the scattering elements 120 at these points may help render the total emitted light from the lamp 100 more uniform. At points such as point e, similar to the embodiment above, this may be accomplished by scattering hence decreasing the total intensity of the light emitted from the ending portions 115 for a plurality of LED filaments 110. The scattering element 120 may also aid in smoothing out the abruptness of light distributed from the ending portions 115 of the LED filaments 110. At points g and similar, where the scattering element encompasses the ending portions 115 of a single LED filament 110, the uniformity or homogenity is achieved by decreasing the abruptness of light emitted from the ending portions 115 through scattering.

FIG. 1*c* is yet another embodiment of the present invention which comprises one filament 110 with a helical shape. As mentioned above, the helical shaped filament 110 may be of flexible material, which provides for the flexibility. It may also be a rigid filament 110, pre-molded in the shape of a helix. The stem 150 connects the ending points z of the helical filament 110 to the electrical connector 140. In this embodiment, at each bend (points x) of the helical filament 110, a scattering element 120 is positioned. Again, it may be that at these bending points x the intensity of the emitted light differs from the rest of the filament, i.e. is higher. Placing the scattering elements 120 at these bending points x may help diffuse light emitted from that portion of the filament 110, to attain a more uniform overall light distribution from the lamp 100.

Figure 1A:
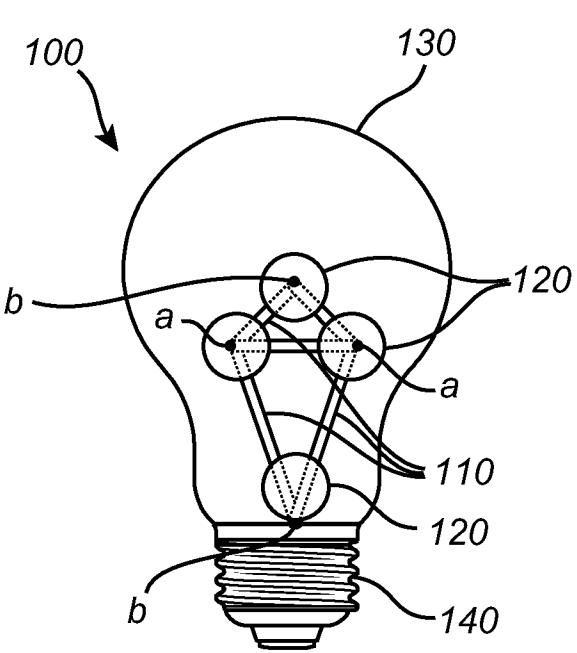
Figure 4:
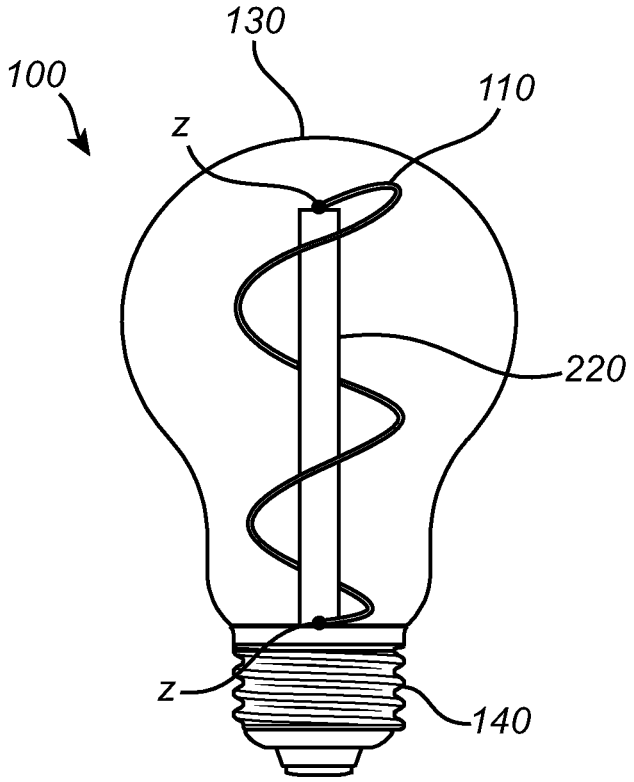
FIG. 4 depicts an embodiment of the invention wherein the light scattering element has a cylindrical shape.

The scattering elements 120, 220 may have a spherical shape (as shown in FIGS. 1*a*, 1*b*, and 1*c*), or may have a cylindrical shape demonstrated in FIG. 4 which in a portion of the LED filament 110 is positioned, or any other geometrical shape.

In the embodiment demonstrated in FIG. 4, similar to FIG. 1*c*, the filament 110 is a helical filament. The cylindrical scattering element 220 may be positioned such as to cover the stem 150 (not shown in FIG. 4) which connects the ending points z of the helical filament 110. In some embodiments it may also be that the filament 110 at least partially continues within the scattering element 220. In that case, the stem 150 may be shorter, or in case the filament 110 continues across the entire length of the scattering element 220, may not exist. In either case, if the scattering element 220 covers the stem, it may provide better aesthetics, as the electrical contacts will be hidden within the light scattering element 220. It may be that the cylindrical light scattering filament in FIG. 4 is the stem 150. This embodiment would provide the benefit of less required electrical wiring.

Figure 5A:
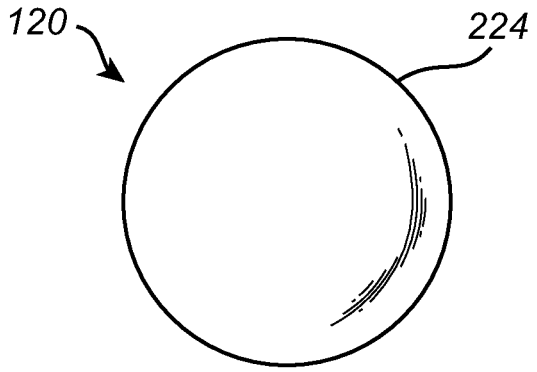
FIGS. 5*a* and 5*b* show side and cross sectional views of a spherical light scattering element, respectively.
Figure 5B:
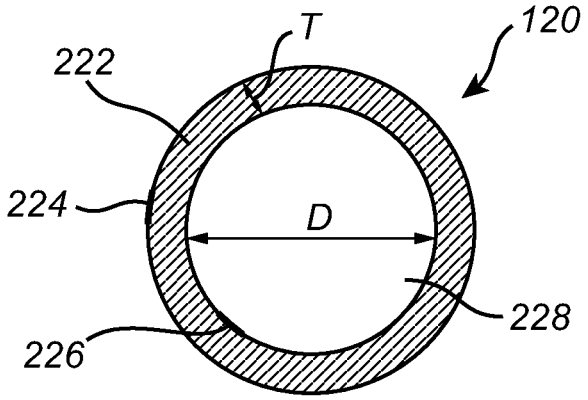
Figure 6A:
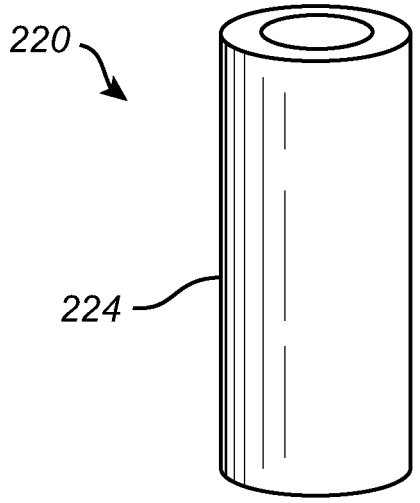
FIGS. 6*a* and 6*b* show side and cross sectional views of a cylindrical light scattering element, respectively.
Figure 6B:
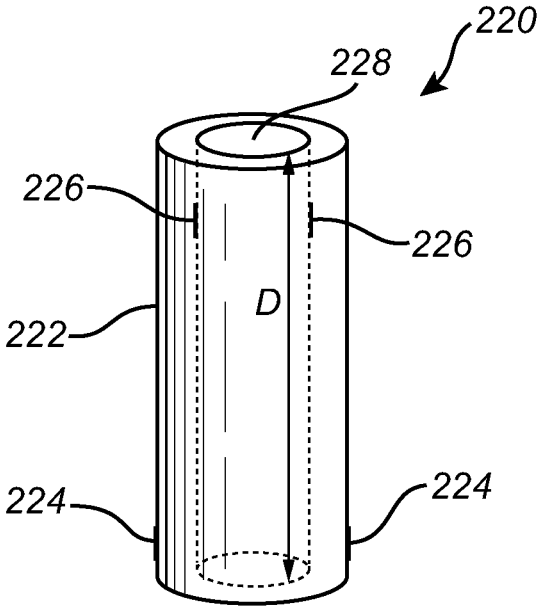

Two different embodiments of the scattering element, namely the spherical 120, and the cylindrical 220 embodiments are demonstrated from the side views, and cross sectional views in FIGS. 5 and 6, respectively. The scattering element 120, 220 comprises a light scattering shell 222 surrounding a transparent volume 228, in which a portion of at least one LED filament 110 is positioned.

The shell 222 may have a certain thickness T, and/or comprise one or multiple layers of different material with different reflective indices. Note that the thickness T of the scattering shell 222 needs not to be equal throughout its entirety.

The transparent volume 228 may have a largest dimension D. In the case of a symmetrical transparent volume 228 such as a sphere, all three dimensions of the transparent volume 228 will be equal, which would be the inner diameter of the surrounding spherical shell 222 in FIG. 5. In case of a non-symmetrical inner volume 228, such as a cylinder, at least one dimension will be larger than the others. This would be the longitudinal axis of the cylinder in FIG. 6. Note that the shape of the transparent volume 228 needs not follow the overall and outer surface 224 of the surrounding shell, hence the exterior shape of the scattering element 120, 220. The thickness T of the shell 222 may be less than 0.5, preferably less than 0.3, and more preferably less than 0.1 times the largest dimension D of the transparent volume 228. For example, in FIG. 5*b* the thickness T of the outer shell 222 is around 0.2 times the diameter (largest dimension) D of the inner volume 228.

Figure 2A:
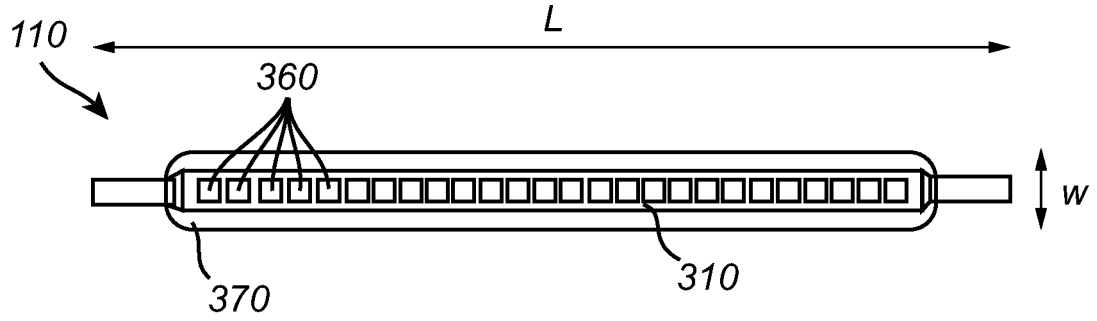
FIG. 2*a* demonstrates a top view of such an LED filament according to at least on embodiment of the invention.
Figure 2B:
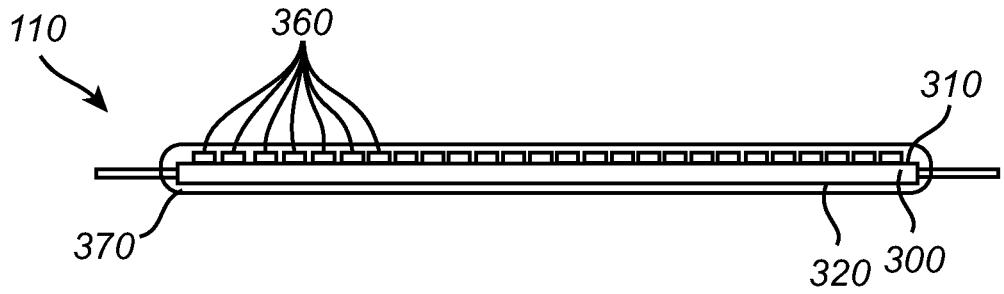
FIGS. 2*b*-2*d* demonstrate side views on LED filaments according to different embodiments of the invention.
Figure 2C:
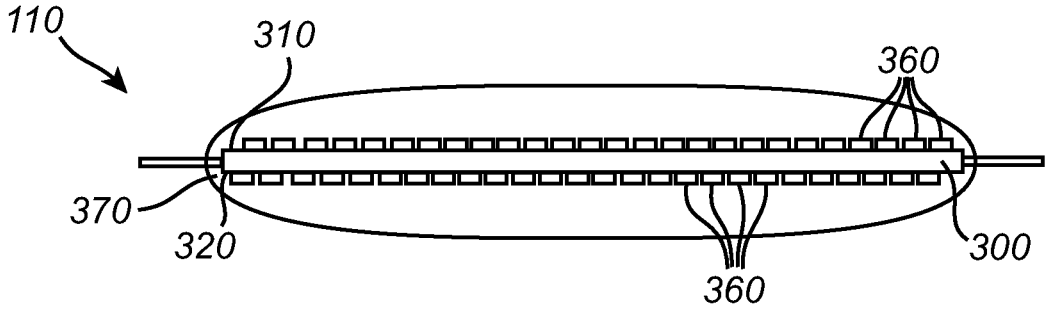
Figure 2D:
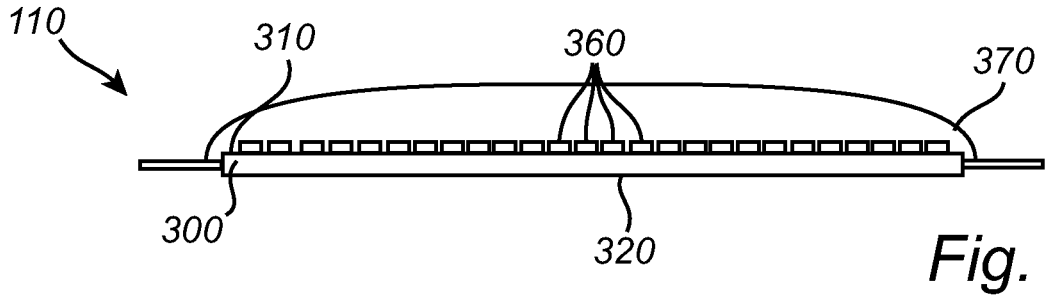

In addition, the longest dimension D of the transparent volume 228 may preferably be less than 0.5 times less than, and most preferably 0.3 times less than the longest dimension of each LED filament (L in FIG. 2*a*).

The transparent volume 228 may have a refractive index different to that of the shell 222.

The shell 222 may be comprised of a plurality of layers deposited on one another. In this case the outer surface 224 defining the shape of the light scattering element 120, 220, will be the outmost layer constituting the shell 222.

Alternatively, the shell 222 may be comprised of a core, inner material, and one or more layers deposited on the outer side of this core material, which again the outmost of these layers will define the outer surface 224 of the shell 222. Another alternative to the latter embodiment is if the one or more layers are deposited on the inner side of the shell. In this case, the innermost layer will define the inner surface 226 of the shell 222. Alternatively, it may be that, coating layers are deposited on both the inner and outer sides of the core material of the shell 222.

In some embodiments it may be that one or more of the layers of the shell 222 are made of a semi-reflective material, or coated with a semi-reflective coating. In this case, light may be reflected numerous times before it exits the outer surface 224 of the light scattering element 120, 220. In this case the reflectivity of the semi-reflective material will play a significant role one the average number of times a ray of light is reflected internally within the thickness T of the light scattering element 120, 220 before exiting. This in turn will affect to what degree light emitted from the encompassed portion of the filament(s) 110 will be diffused. As a general rule of thumb, the higher the number of scattering events within the thickness T of the shell 222, the higher the dissipation of light exiting the outer surface 224 of the shell 222 of the light scattering element 120, 220.

It may be such that, the outer surface 224 and/or inner surface 226 of the shell 222 of the light scattering element 120, 220 is defined by a matrix material, and a reflective material such that the reflective material may be embedded in the matrix material. The matrix material may be light transparent, or semi-transparent, or semi-reflective. In case of reflectivity, the refractive index of the matrix material may differ from that of the semi-reflective material. In this case light propagating through the matrix material may be scattered differently from when propagating through the semi-reflective material.

In one embodiment, the matrix material may comprise a polymeric material. This polymeric material may be light transparent, semi-transparent, or semi-reflective.

In other embodiments it may be that the core material of the shell 222 comprised semi-reflective material.

The scattering element 120 may be comprised of material such as a polymer matric with light scattering particles, such as for example BaSO4, TiO2 and/or Al2O3, and/or a roughened or structured surface from either one or both the outer 224 and the inner 226 surfaces of the outer shell 222.

The reflectivity of the semi-reflective material may be in the range of 30-80%, preferably 35-70%, and most preferably 40-60%. In this case, it may be that, depending of the reflectivity of the semi-reflective material, light emitted from the portion of the LED filament 110 within the light scattering element 120, 220 propagates through, and exits from the light scattering element 120, 220 without undergoing any reflections, while a portion of the emitted light may undergo one or more reflections before exiting the light scattering element 120, 220. As a result of the shell 222 comprising semi-reflective material the light scattering element may serve as a mixing chamber wherein the light emitted by the encompassed portion of the LED filament 110 is mixed. In the case of the inner surface 226 of the shell 222 being the sole portion with semi-reflective material, the transparent volume 228 of the light scattering element 120, 220 will act as a mixing chamber. This is due to the fact that light will undergo numerous reflections off the inner surface 226 back into the transparent volume 228 before it eventually propagates through the inner surface 226, into the thickness T of the shell 222, and finally exits the outer surface 224 of the light scattering element 120, 220.

The person skilled in the art realizes that the present invention by no means is limited to the preferred embodiments described above. On the contrary, many modifications and variations are possible within the scope of the appended claims. For example, there may be any other number of LED filaments in the bulb, and the scattering elements may be arranged in any number of manners, still implementing the invention.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. An LED filament lighting device comprising, at one or more LED filaments, each including a plurality of LEDs mounted on an elongated substrate and each having ending portions, at one or more light scattering element, each including a light scattering shell surrounding a transparent volume, each light scattering element being arranged to encompass at least one LED of at least one LED filament, and configured to scatter light emitted from the encompassed LED(s), thereby forming a first LED set including at least one LED encompassed by scattering element(s), and a second LED set including a plurality of LEDs not encompassed by scattering element(s), wherein said one or more scattering elements encapsulates the ending portions of at least two of the LEDs filaments where the at least two LEDs filaments are connected, or where the at least one scattering element is positioned at a bend of the one or more LED filaments, and wherein a light distribution from said first LED set combines with a light distribution from said second LED set to provide a homogeneous total light distribution from said LED filament lighting device.

2. The LED filament lighting device according to claim 1, wherein said light scattering shell is configured to be semi-reflective, such that light is mixed within said light scattering element.

3. The LED filament lighting device according to claim 2, wherein in inner surface of the light scattering shell has a reflectivity in the range of 30-80%, preferably 35-70%, and most preferably 40-60%.

4. The LED filament lighting device according to claim 1, comprising at least two light scattering elements, each encompassing at least one LED of a common LED filament.

5. The LED filament lighting device according to claim 1, wherein at least one light scattering element encompasses at least one LED of at least two different LED filaments.

6. The LED filament lighting device according to claim 1, wherein each LED of the first LED set is situated at an outer end of a respective LED filament.

7. The LED filament lighting device according to claim 1, wherein said first LED set comprises at least one red (R), one green (G), and one blue (B) LED on one LED common filament.

8. The LED filament lighting device according to claim 1, wherein each light scattering element encompasses a portion of said LED filament having a length which is less than 0.5, preferably less than 0.3, and most preferably less than 0.2 of the total length of the LED filament.

9. The LED filament lighting device according to claim 1, wherein a thickness of said shell is less than 0.5, preferably less than 0.3, and more preferably less than 0.1 times a largest dimension of said transparent volume.

10. The LED filament lighting device according to claim 1, wherein a longest dimension of each transparent volume is less than, preferably 0.5 times less than, and most preferably 0.3 times less than a longest dimension of each LED filament.

11. The LED filament lighting device according to claim 1, wherein at least one light scattering element fixates one LED filament to another LED filament.

12. The LED filament lighting device according to claim 1, wherein at least one light scattering element mechanically connects two or more LED filaments.

13. The LED filament lighting device according to claim 1, wherein the transparent volume of the scattering element has a refractive index equal to that of the light scattering shell.

14. A retrofit light bulb, comprising at least one LED filament lighting device according to claim 1, a transmissive envelope at least partly surrounding said LED filament(s) and said scattering element(s), and a connector for electrically and mechanically connecting said light bulb to a socket.

15. The retrofit light bulb according to claim 14, wherein at least one light scattering element fixates a LED filament to a structure of the retrofit light bulb.

* * * * *